United States Patent [19]

Morin

[11] 4,456,242

[45] Jun. 26, 1984

[54] APPARATUS FOR SHINGLING STACK OF FLAT ARTICLES

[76] Inventor: George A. Morin, P.O. Box 826, Aurora, Colo. 80010

[21] Appl. No.: 262,042

[22] Filed: May 11, 1981

[51] Int. Cl.[3] ..... B65H 1/06; B65H 3/12; B65H 5/00; B65H 9/00

[52] U.S. Cl. ..... 271/94; 271/104; 271/35; 271/225; 271/248; 414/128; 414/130

[58] Field of Search ..... 271/1, 2, 10, 11, 12, 271/13, 15, 35, 94, 96, 99, 104, 184, 185, 225, 171, 195, 248, 250, 251; 414/130, 128

[56] References Cited

U.S. PATENT DOCUMENTS

| | | | |
|---|---|---|---|
| 629,348 | 7/1899 | Fischer | 271/2 |
| 3,123,354 | 3/1964 | Ungerer | 271/197 |
| 3,202,302 | 8/1965 | Insolio | 271/197 |
| 3,212,772 | 10/1965 | Ward | 271/35 |
| 3,219,339 | 11/1965 | Gutierrez | 271/94 UX |
| 3,262,697 | 7/1966 | Krinke . | |
| 3,583,341 | 6/1971 | Birdsong et al. | 112/121.29 |
| 3,718,328 | 2/1973 | Comstock | 271/20 |
| 3,806,115 | 4/1974 | Wojtowicz et al. | 271/184 |
| 4,081,181 | 3/1978 | Crowe et al. | 271/35 |

FOREIGN PATENT DOCUMENTS

| | | | |
|---|---|---|---|
| 650394 | 9/1937 | Fed. Rep. of Germany | 271/1 |

*Primary Examiner*—Robert B. Reeves
*Assistant Examiner*—James Barlow

[57] ABSTRACT

Apparatus is provided for taking a stack of flat articles such as folded newspapers, and delivering them successively to a conveyor in an overlapped or shingled arrangement to move to a processing station for labeling or addressing or for opening them to receive inserts. A rectangular hopper or gate is located over a traveling belt means to hold a stack of such flat articles with its converging angle pointing downstream. Each bottom article is gripped by the belt means, which is vacuumized in the area under the stack, and is pulled under the gate and downstream.

When a given article is only partially through the gate, the succeeding article is gripped primarily by its side portions and pulled under the gate in overlapping or shingled relation with the preceding one, each article being arranged with its side edges at a substantial angle to the direction of travel. A shield underlies the rear portion of the stack to prevent gripping the rearmost portions of the articles until they are moving with the speed of the belt to prevent distortion or damage.

3 Claims, 9 Drawing Figures

APPARATUS FOR SHINGLING STACK OF FLAT ARTICLES

DESCRIPTION

1. Technical Field

This invention relates to an apparatus for sequentially separating a plurality of flat articles, such as folded newspapers, from a generally vertical stack and transporting them in a generally horizontal line in overlapping relation to a downstream station for some further step in processing. The structure and operation are such that the transfer from one mode to the other is made rapidly and continuously without damage to the articles.

2. Background Art

Many different kinds of articles both rigid and flexible are arranged in bundles or packs or stacks for various purposes. They may be cards so arranged simply for storage in file drawers where they will be available for future reference. Or they may be stacked for transfer to an area where some further work is to be done on them.

In the case of newspapers, for example, bundles or stacks may be delivered from the press room to a zone where they must be separated sufficiently to permit individual addressing or labeling or other work, and they must be laid out in horizontal lineal fashion in order for the work to be done. Manual handling of the individual papers is impractical because of the tremendous number and the limited time available, and such handling tends to result in considerable damage and distortion.

Various schemes have been proposed in the past for handling cards or individual sheets and even pieces of fabric to achieve the type of separation mentioned above, but none seems to be suitable for the present purpose.

One example in the U.S. Pat. No. 3,718,328 to Comstock which shows an extremely complicated machine for removing cards seqientially from a large stack in a hopper by means of a revolving vacuum pickup arm and carrying them to a location on a conveyor where they become arranged in a shingled fashion and are secured together in groups to serve as index files.

Another example is the U.S. Pat. No. 3,262,697 to Krinke which shows a machine having a hopper holding a stack of file cards over an endless belt surfaced with cellophane tape with an adhesive side facing out. The belt picks the cards from the bottom of the stack one by one and advances them to a viewing station where they may be reviewed or actually removed. The tape has a very low adhesion and the cards may be dumped into a tray simply by moving the belt an additional short distance. Such a machine could not possibly serve to handle any reasonably heavy articles at any useful speed.

The U.S. Pat. No. 3,583,341 to Birdsong, et al discloses a machine for separating a stack of pieces of fabric and moving them individually in a horizontal direction to a work station. He uses a perforated, driven, endless belt with a hopper over the belt inclined downwardly and forwardly to hold the stack of fabric pieces. The belt is coated with a tacky material to cause it to pull each bottom piece out of the hopper, and a vacuum source is also located beneath the belt under the forward part of the hopper to exert vacuum grip on the fabric. Each piece issues singly through a narrow slot onto a work table for processing. While this machine appears to be suitable for its intended purpose, it cannot produce a shingled line of flat articles traveling on a conveyor.

DISCLOSURE OF INVENTION

In accordance with this invention, an apparatus for shingling a stack of generally rectangular flat articles is provided which includes an elongate supporting stand carrying a conveyor for transporting such articles. The stand is generally elongate and rollers are mounted on the stand in the vicinity of each end for rotation about axes extending transversely of the longitudinal axis of the stand. One of the rollers is driven by a motor carried by the stand and drives endless belt means which is mounted on the rollers in such fashion that the upper reach of the belt means travels in a selected downstream direction. The belt means may be several belts arranged across the width of the rollers although a single belt is presently preferred and is maintained taut on the rollers by means of adjustable pillow blocks mounting one of the rollers on the stand.

The belt is perforated throughout its length and width to provide a multiplicity of holes therethrough. A plenum is located under the upper reach of the belt in its upstream portion and has suitable air passageways communicating with the holes in the belt with the interior of the plenum. A suitable conduit connects the interior of the plenum to a vacuum pump carried by the stand, and when the pump is actuated a vacuum will be drawn through the plenum and through the holes in the belt in the area above the plenum, so that the belt can exert a vacuum grip on any flat article lying in contact with that portion of it.

To carry out the purposes of the invention a gate is provided which is carried by the stand and extends above the belt and across it with its lower edge slightly above the surface of the belt. The gate may be thought of as a generally upright rectangular hopper with two adjacent walls missing, and with the other two walls lying in planes at right angles to each other and at about forty-five degrees to the longitudinal axis of travel of the belt, with their converging angle pointing downstream. It is so located on the stand that a stack of generally rectangular flat articles of any appropriate dimensions placed therein for processing will overlie a portion of the belt vacuumized by the plenum. The lower edges of the gate are located slightly above the belt to provide clearance for the bottom article in the stack to pass thereunder when the belt grips it and moves it downstream.

The gate constrains the stack in proper position somewhat upstream of the mid portion of the conveyor with all of the side edges of the articles set at about a forty-five degree angle to the direction of travel of the belt. As the bottom article moves under the gate, it begins exposing side and back portions of the next article to the vacuumized portion of the belt which grips it and starts it moving while it still overlaps the preceeding articles. The result is a shingled array of the articles moving downstream in a line to a transfer point or a processing station.

A generally planar shield may be provided which overlies a rear portion of the stand and conveyor including the belt and lies closely above the belt surface. Its forward edge may be far enough forward to cause the shield to underlie about the rear half of the stack. The shield serves two purposes, one of which is to support a substantial part of the weight of the stack and hold it above the belt. The other is to blank out the vacuumized area of the belt which underlies the rear portion of the stack and prevent the belt from applying the vacuum grip to a large rear triangular portion of each successive article until a more forward portion has been gripped and "pulls" the rear along. This feature is highly desirable with newspaper sheet which is very fragile and cannot endure any pushing force. As a preceding article moves forward under the gate, the area of the succeeding article in contact with the belt increases rapidly, and it is traveling at full speed before the preceeding article advances far enough to be out from under it. The result is an overlapped arrangement referred to as shingling.

A further feature is the provision of a secondary conveyor located with its upstream end adjacent to the downstream end of the first conveyor and arranged at an angle corresponding to the angle of the articles on the first belt. As they move across a transfer plate onto the second conveyor they become automatically aligned in their new direction of travel with their leading edges extending substantially normal to the new direction of travel. Various other advantages and features of novelty will become apparent as the description proceeds in conjunction with the accompanying drawings.

DESCRIPTION OF PREFERRED EMBODIMENTS

Figure 1:
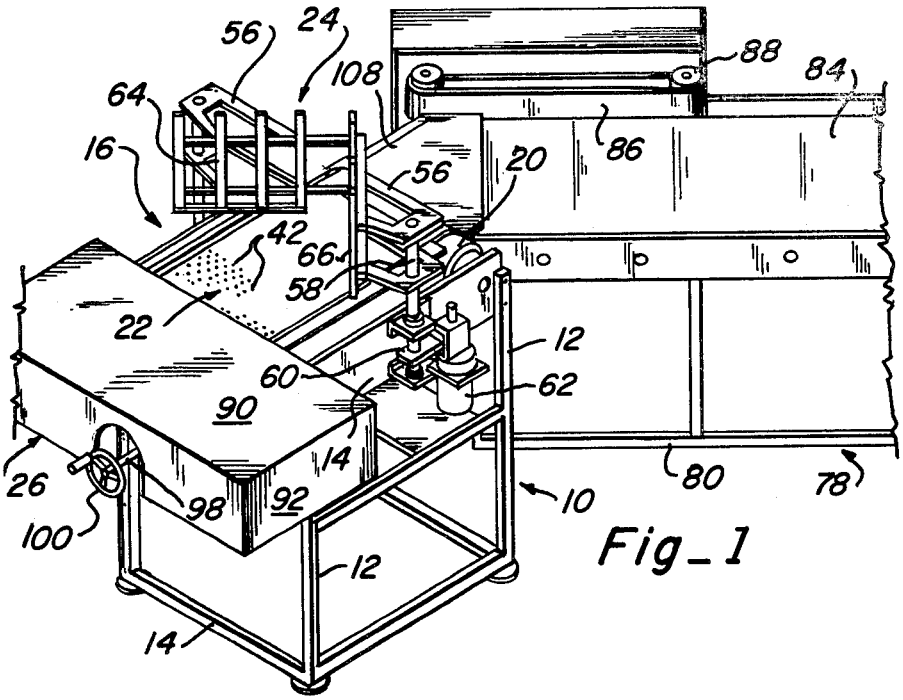
FIG. 1 is a fragmentary perspective view of a preferred form of apparatus incorporating the invention.

The general arrangement of some of the major components of the invention in their operating position is illustrated in FIG. 1, in which a first supporting stand 10 of generally skeletal nature having vertical structural members 12 and horizontal structural members 14 is somewhat elongate and rectangular in planform. The stand carries a first conveyor 16 including a pair of supporting rollers 18 and 20 and an endless belt 22 mounted on the rollers in taut condition and driven by roller 20 in a selected downstream direction, which is toward the right in FIG. 1.

Figure 2:
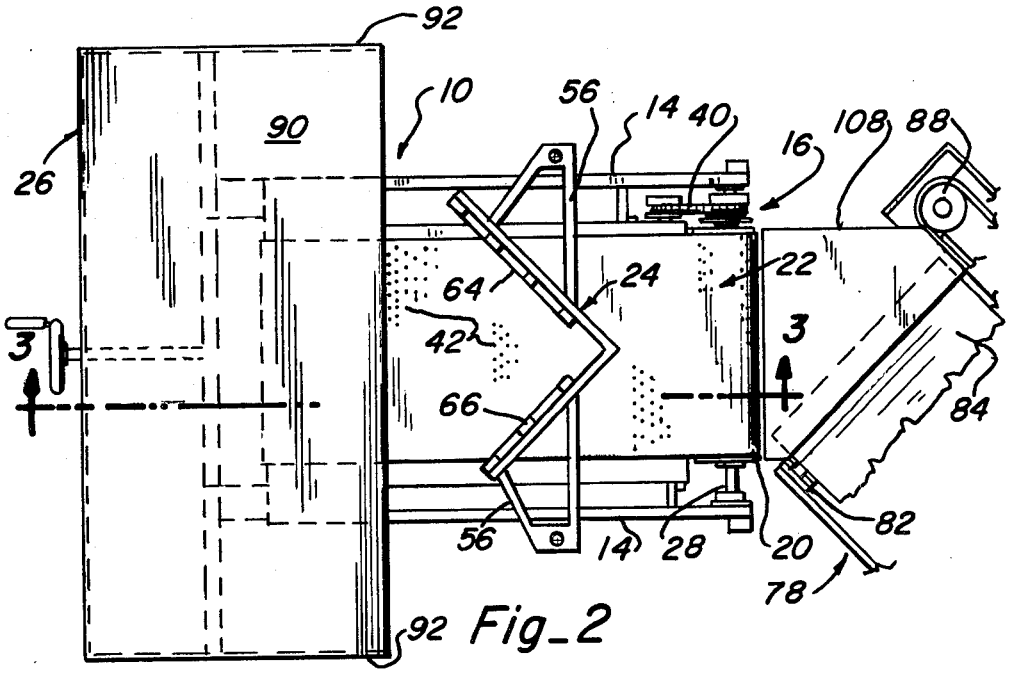
FIG. 2 is a top plan view of a major portion of the apparatus shown in FIG. 1.

As seen in FIGS. 1 and 2, a gate or hopper 24 is located above and extends across the belt 22 and is adapted to receive and restrain a stack of generally rectangularly shaped flat articles, the bottom one of which is in contact with the belt, so that they will move downstream sequentially in accordance with a plan, as will be explained later.

A shield 26, which is shown as generally rectangular and extensive laterally and longitudinally, is mounted on the rearward portion of the stand in a position to underlie the rear portion of a stack of articles stored in the hopper 24 and support a substantial part of their weight as well as for other purposes to be described in detail later. The shield is mounted on the stand for fore and aft movement toward and away from the hopper in a controlled fashion.

Figure 4:
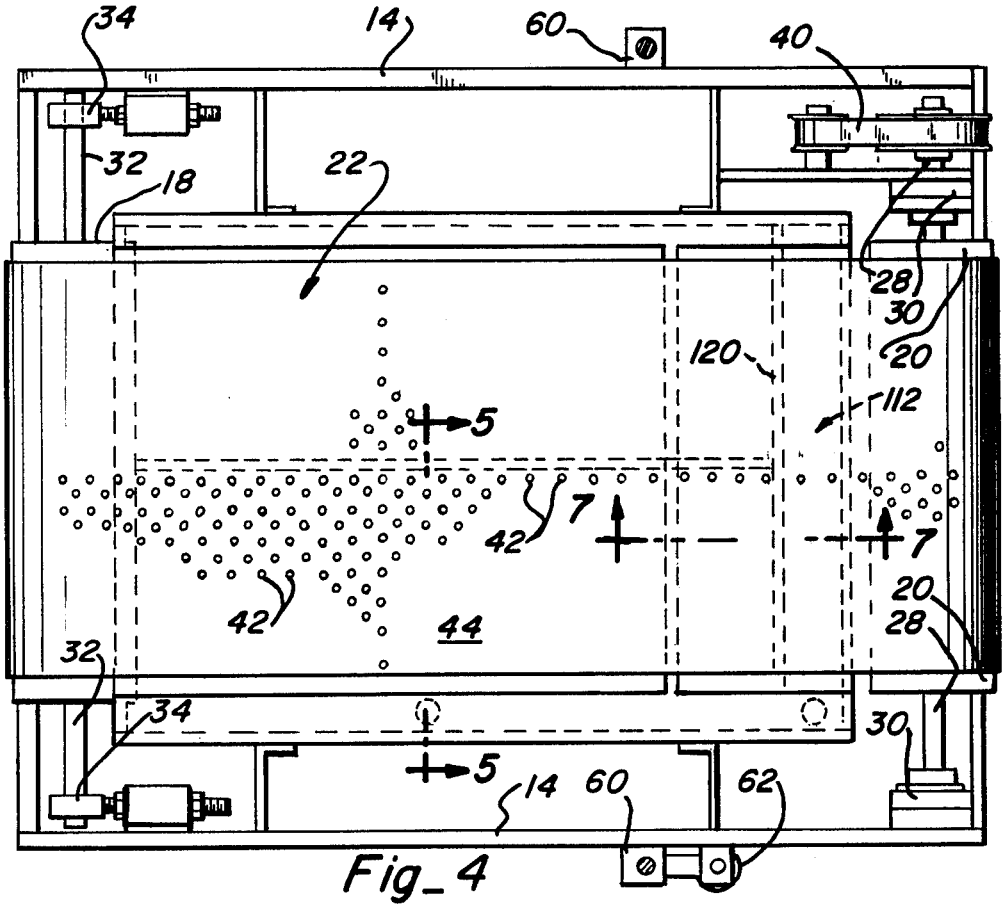
FIG. 4 is an enlarged top plan view of the apparatus taken on line 4—4 of FIG. 3.

Considering FIGS. 1 and 4 in greater detail, it will be seen that the elongate horizontal side rails 14 of the stand are platelike to provide the strength and rigidity to carry the various components attached to them. The rollers 18 and 20 are shown as being at the extreme ends of the stand but this is not essential. The stand could be longer for various reasons and the rollers could then be well inboard of the ends. The forward roller 20 is mounted by its shaft 28 in fixed bearings 30 while the rear roller 18 is mounted by its shaft 32 in a pair of adjustable pillow block bearings 34 having screw shaft connections to the side rails 14. When the belt is mounted on the rollers it is then drawn taut by adjustment of roller 18. An electric motor 36 is mounted on platform 38 and drives 28 of roller 20 through a flexible belt 40. Roller 20 in turn drives belt 22 with its upper reach traveling in the selected downstream direction.

The belt 22 may be two or more separate belts mounted on the same rollers with no gaps or relatively large gaps between them but it is presently preferred to use one belt extending across the full width of the rollers. The purpose is to pick flat articles successively from the bottom of a stack stored in hopper 24 and transport them in shingled array to a transfer station or a processing zone. The belt is perforated with a multiplicity of holes 42 spaced across and along the length of the belt and preferably extend in parallel fore and aft lines. These holes are provided for use in connection with a vacuum source to produce a vacuum grip on the upper surface of a given area of the belt in order to remove a bottom article from a stack with certainty.

Figure 3:
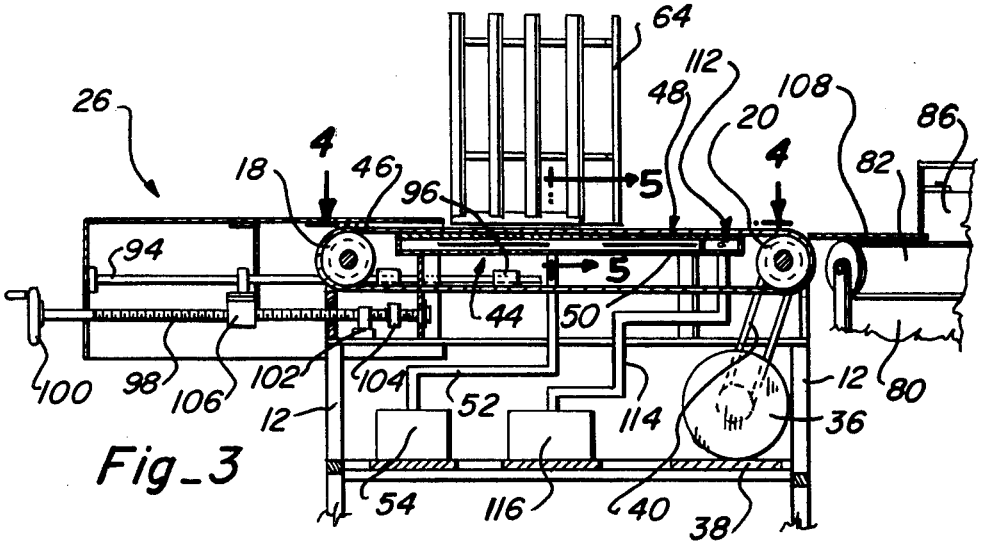
FIG. 3 is a sectional elevational view of the apparatus taken on line 3—3 of FIG. 2.

As seen in FIGS. 3 and 4 a generally planar plenum 44 is located immediately beneath the upper reach 46 of the belt and extends across its width and throughout a major portion of its length, in any event at least the majority of the upstream portion of its length. The upper wall 48 of the plenum is provided with air passages to be described communicating some of the holes in the belt with the interior of the plenum. The plenum itself is closed with a lower wall 50, and a conduit 52 connects the interior of the plenum 44 with the vacuum pump 54 carried by platform 38. When the pump is in operation it creates a suction at the upper surface of a selected portion of the belt which can then exert a vacuum on the bottom article in the stack and move it downstream.

The hopper or gate 24 includes left and right open frameworks 56 carried on upright 58 at each side of the stand and the uprights are mounted in brackets 60 for vertical adjustment as needed. A controllable and reversable motor 62 drives the uprights in either direction through suitable gearing, not shown. The frameworks 56 carry two walls 64, 66 which are mounted in an upright position and lie in planes at right angles to each other and at about forty-five degrees to the longitudinal axis of travel of the belt with their converging angle pointing downstream. Thus it forms a hopper which is open to the rear. The bottoms of the two walls are spaced slightly above the surface of the belt to form a gap through which each article may exit, and the gap is adjustable to accommodate articles of different thicknesses. Preferably the bottom marginal portion of each wall is composed of downwardly extending bristles which can yield to double thicknesses of the articles.

Figure 8:
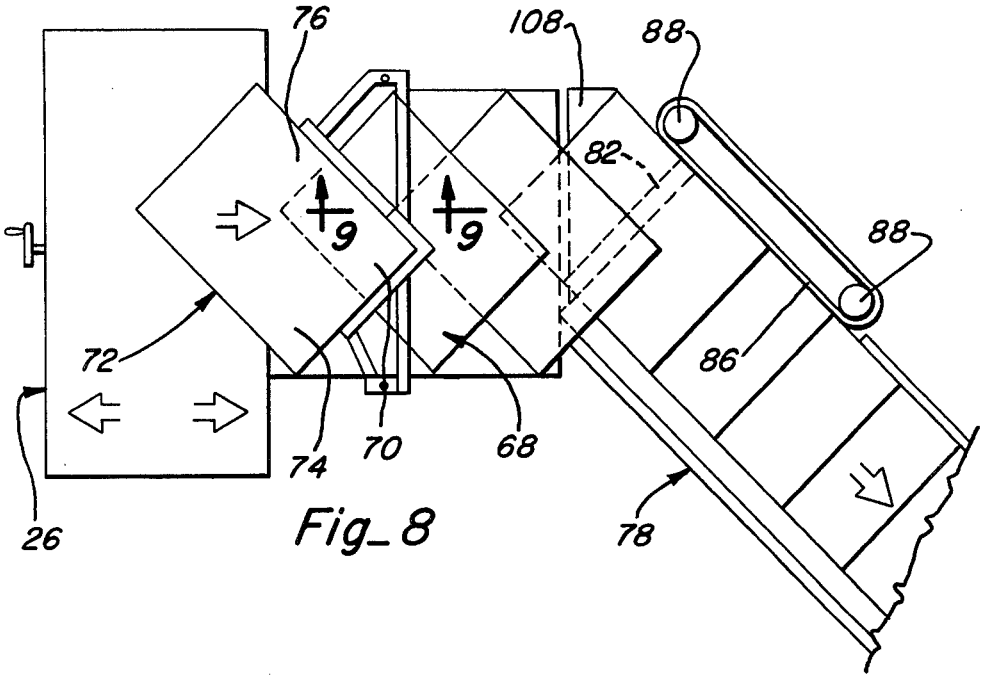
FIG. 8 is a diagrammatic plan view of the apparatus of FIG. 1 showing the sequence of movements of the articles.

Shield 26 overlies the aft end of the conveyor and in the position shown in FIGS. 1, 2 and 8 lies back of the gate about far enough to underlie the rear half of the article designed to be handled by the machine, in this case a folded newspaper. Thus, it will take the weight of about half of the stack placed behind the gate. At the same time it will prevent the vacuumized belt from exerting any vacuum grip on the rear half of each bottom article in succession.

Figure 9:
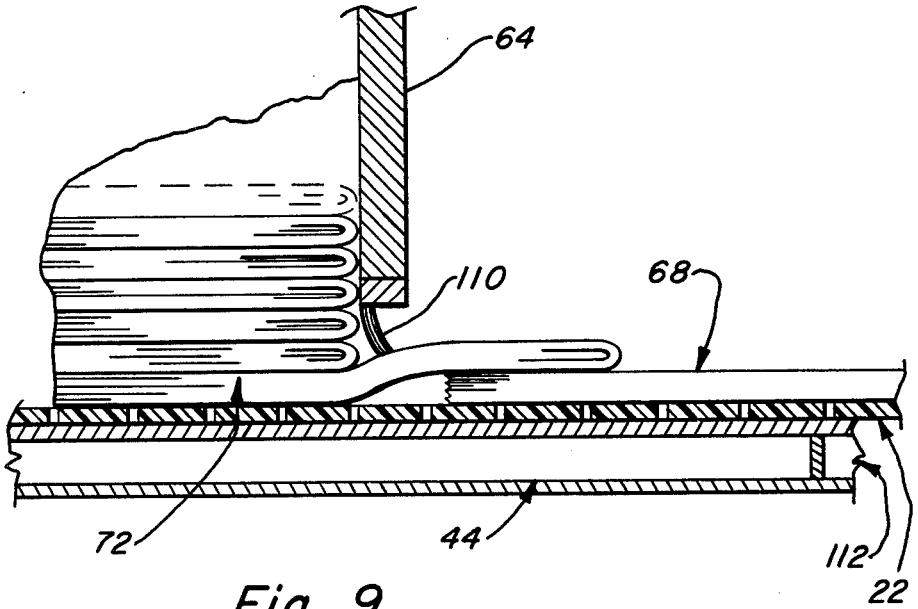
FIG. 9 is a greatly enlarged vertical sectional view of the gate and plenum taken on line 9—9 of FIG. 8 showing the movement of articles beneath the gate.

FIG. 8 is in effect a flow diagram of the apparatus of FIG. 1 in action and FIG. 9 shows the arrangement of a stack of newspapers behind the gate with the lowermost paper extending partly thereunder. In the "stop-motion" view in FIG. 8, a first paper 68 has moved about half way out of the gate and is gripped throughout the belt. It underlies portion 70 of the second paper 72 and thus the belt exerts no grip on this area either, although the moving paper 68 does exert a downstream draw on it. The right and left portions 74 and 76 of paper 72 forward of shield 26 do drop down into contact with the belt which thus exerts a vacuum grip and pulls paper 72 forward, with the aft portion sliding off the shield and also being gripped by the belt. Hence there is no vacuum gripping of the aft portion of the paper while the belt is traveling forward with respect to it, and the whole paper is "pulled" into movement, thus avoiding any buckling or tearing.

When it is desired to transfer the articles or papers to a further point for any particular type of processing, a second conveyor 78 may be used. This includes a supporting stand 80 with a plurality of rollers such as 82 and a conveyor belt 84 mounted on the rollers, as well as means, not shown, to drive the belt. A guide belt 86 mounted on vertical driven rollers 88 engages each paper as it leaves the first conveyor and urges it downstream on the second conveyor belt. Since the second conveyor is angled at about forty-five degrees to the first, the papers are now aligned with their leading edges extending transversely to their direction of travel. A generally triangular transfer plate 108 is provided to bridge the gap between the downstream end of belt 22 and the upstream end of belt 84 to support the papers in their transition from the first direction of travel to the second.

Shield 26 has a straight transverse forward edge and is preferably rectangular as shown. It is movable longitudinally back and forth in order to vary the support given to the stack of flat articles because of total weight or other reasons and also to vary the area of the bottom article in the stack subjected to the vacuum grip of the belt. This also depends on the quality and thickness of the material, the speed of operation, and other factors. The shield is open at the front, has a flat top 90, and depending side walls 92. A guide rod 94 extends longitudinally near each side wall and is carried in bearing 96 carried by the stand. An adjustment screw 98 with a hand wheel 100 is mounted for rotation in bearings 102 and 104, and coacts with nut 106 carried by the shield to move it with respect to the stand.

The view in FIG. 9 generally illustrates the instantaneous position distance forwardly of their position in FIG. 8, and shows how the bristles 110 have yielded to allow the forward portion of paper 72 to move under the gate before the rearward portion of the paper 68 has completely left. The result is the desired shingling effect.

In order to avert any possibility that belt 22 will not release the articles as they reach the downstream end of the conveyor, means are provided to positively break the vacuum grip of the belt shortly before it reaches roller 20 in the form of a plenum 112 connected by conduit 114 to a pressure pump 116 mounted on platform 38. When the pump is activated it pressurizes the plenum, which has air passage means communicating with the holes in belt 22 to create a positive pressure which eliminates any remaining vacuum grip. Plenum 112 and the much larger vacuum plenum 44 preferably comprise a single elongate container 118 divided into separate compartments by a transversely extending divider member 120, with plenum 112 at the downstream end.

Figure 5:
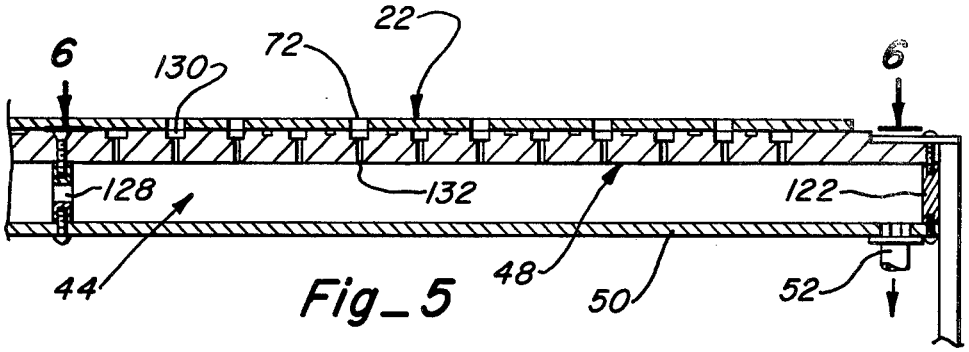
FIG. 5 is an enlarged sectional elevational view of a portion of the apparatus taken on line 5—5 of FIGS. 3 and 4.
Figure 6:
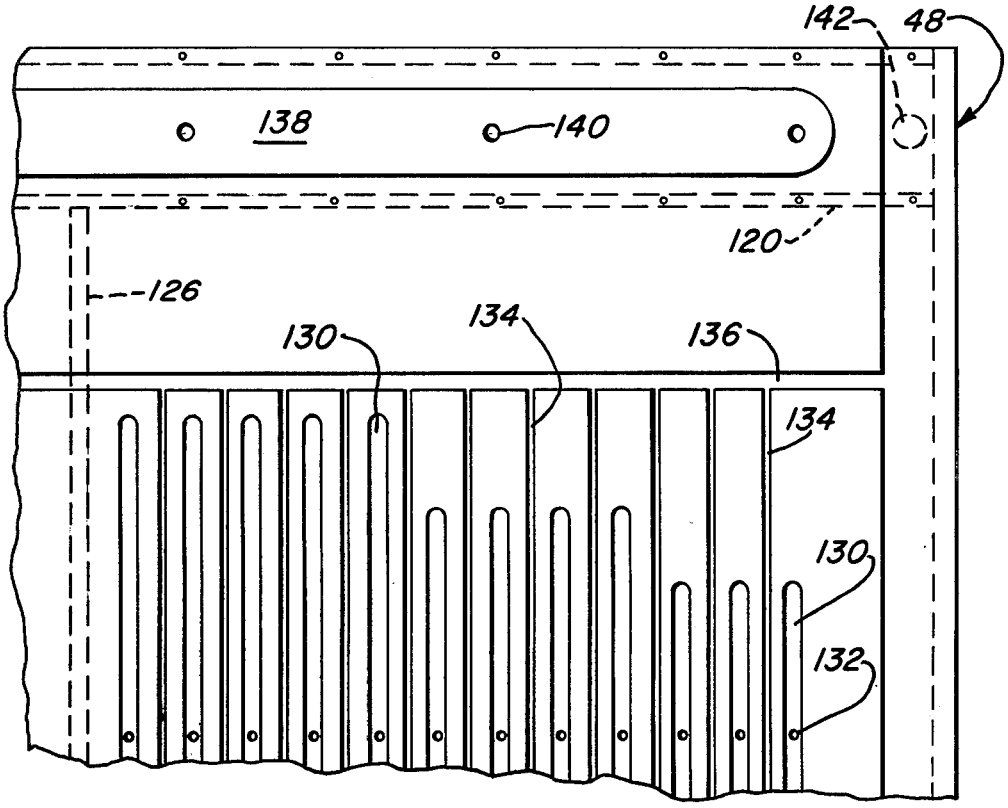
FIG. 6 is a top plan view of a portion of the plenum upper wall taken on line 6—6 of FIG. 5.
Figure 7:
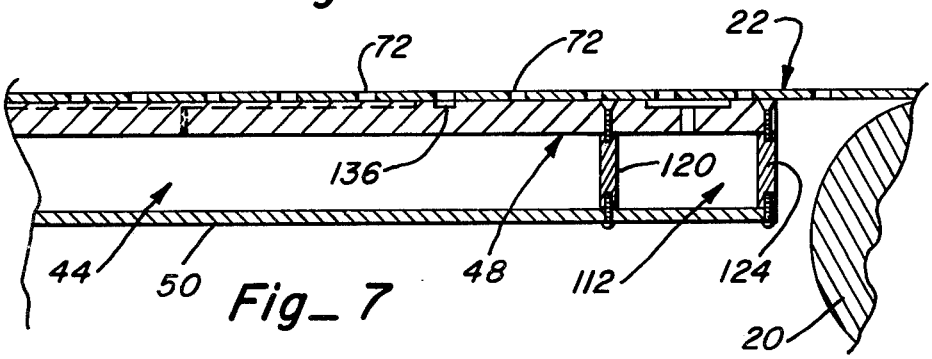
FIG. 7 is an enlarged vertical sectional view of a portion of the plenum structure taken on line 7—7 of FIG. 4.

In FIGS. 5 and 7, it can be seen that the upper and lower walls 48 and 50 of the combined plenum container are united by side and end walls 122 and 124 by means of screws or other suitable fasteners, and a reinforcing member 126 extends longitudinally in the container from the upstream end until it meets with divider member 120 which also serves as a lateral reinforcement. Opening 128 in member 126 allows ready circulation between the two sides of the vacuum plenum.

Elongate grooves 130 are formed in the upper surface of wall 48 to be in registry with lines of holes 72 in the belt and holes 132 are formed through grooves 130 and wall 48 to bring the grooves in communication with the interior of the plenum so that the vacuum effect can be transmitted to the holes in the belt. It will be noted that the grooves near the center line extend farthest downstream and are shortened successively toward the sides to provide a vacuum field pattern which extends somewhat beyond the horizontal projection of the articles to be handled but not excessively so because maintenance of a vacuum over a large area where it is not needed is a waste of power. Vacuum relief slits 134 are formed between the grooves and are joined by a vacuum relief slot 136 extending laterally.

Wall 48 in the area of the downstream plenum 112 is formed on its upper surface with a narrow, elongate, shallow recess 138 extending across the major portion of the width, and a plurality of holes 140 are formed in the recess through the wall to provide access to the interior of the plenum, allowing pressurized air to flow outward, break any vacuum which might remain, and positively release the papers for transfer to the next stage. Port 142 connects to pressure conduit for transfer to the next stage.

The invention has been described in detail with particular reference to preferred embodiments thereof, but it will be understood that variations and modifications can be effected within the spirit and scope of this invention.

I claim:

1. Apparatus for shingling a stack of flat articles and transporting them to a processing station, comprising:

a supporting stand;

first conveyor means including a pair of rollers on the stand with motor means to drive one of them, endless belt means mounted on the rollers and driven by the driver roller to cause its upper surface to travel downstream and transport articles in a downstream direction;

a gate on the stand located above and extending across the belt means with the lower edges of the gate located slightly above the surface of the belt means;

the gate comprising two upright walls lying in planes at right angles to each other and at about forty-five degrees to the longitudinal axis of travel of the belt means with their converging angle pointing downstream;

the gate serving to constrain a stack of flat articles in position with the bottom article contacting the belt means and to release them successively in shingled relation and each at an angle of about forty-five degrees to the downstream direction of travel; and second conveyor means located at the downstream end of the first conveyor means including a stand, a plurality of rollers, and a conveyor belt mounted thereon with its upper reach adapted to be driven in a downstream direction away from the first conveyor means at about forty-five degree angle to transport each article delivered from the first conveyor means with its leading edge extending transversely of the line of travel of the second conveyor means.

2. Apparatus as claimed in claim 1; in which a generally triangular transfer plate is provided to bridge the gap between the downstream end of the first conveyor means and the upstream end of the second conveyor means to support the articles in their transition from the first direction of travel to the second direction of travel.

3. Apparatus as claimed in claim 1; in which a transition guide is mounted on the second stand at the upstream end of the second conveyor means to locate each article accurately on the conveyor belt;

the guide comprising a pair of longitudinally spaced rollers on vertical axes and a guide belt mounted thereon to be driven with its inward exposed surface traveling downstream in a position to contact a side edge of each article and urge it onward accurately in its new direction.

* * * * *